US006517091B1

(12) United States Patent
Fisher et al.

(10) Patent No.: US 6,517,091 B1
(45) Date of Patent: Feb. 11, 2003

(54) ROLLER SKATE

(75) Inventors: Robert Fisher, North Kingstown, RI (US); Jeffrey LeBlanc, East Greenwich, RI (US)

(73) Assignees: Blue Sky, North Kingstown, RI (US); Outlaw Design, East Greenwich, RI (US)

( * ) Notice: Subject to any disclaimer, the term of this patent is extended or adjusted under 35 U.S.C. 154(b) by 85 days.

(21) Appl. No.: 09/723,604

(22) Filed: Nov. 28, 2000

(51) Int. Cl.[7] ..... A63C 17/00
(52) U.S. Cl. ..... 280/11.26; 280/11.28
(58) Field of Search ..... 280/11.19, 11.22–11.28

(56) References Cited

U.S. PATENT DOCUMENTS

| | | | | |
|---|---|---|---|---|
| 3,790,187 A | | 2/1974 | Radu et al. | 280/11.2 |
| 3,953,041 A | | 4/1976 | Buss | 280/11.26 |
| 4,061,348 A | | 12/1977 | Carter | 280/11.21 |
| 4,272,090 A | | 6/1981 | Wheat | 280/11.22 |
| 4,401,311 A | | 8/1983 | Almeraz | 280/11.1 BR |
| 4,417,737 A | | 11/1983 | Suroff | 280/11.115 |
| 4,553,767 A | | 11/1985 | Robjent et al. | 280/11.21 |
| RE32,346 E | | 2/1987 | Klamer et al. | 280/11.2 |
| 4,657,265 A | | 4/1987 | Ruth | 280/7.13 |
| 4,708,352 A | | 11/1987 | Vullierme | 280/11.26 |
| 4,932,676 A | | 6/1990 | Klamer | 280/11.2 |
| 5,253,883 A | | 10/1993 | Moldenhauer | 280/11.2 |
| 5,400,484 A | | 3/1995 | Gay | 24/585 |
| 5,449,183 A | | 9/1995 | Klamer et al. | 280/11.27 |
| 5,462,297 A | | 10/1995 | Lee | 280/11.2 |
| 5,486,011 A | | 1/1996 | Nelson | 280/11.2 |
| 5,551,712 A | | 9/1996 | Repucci | 280/11.2 |
| 5,582,418 A | * | 12/1996 | Closser | 280/11.225 |
| 5,678,833 A | | 10/1997 | Olson et al. | 280/11.22 |
| 5,704,621 A | * | 1/1998 | Lazarevich et al. | 280/11.225 |
| 5,709,395 A | | 1/1998 | Lee | 280/11.2 |
| 5,913,526 A | | 6/1999 | Olson et al. | 280/11.22 |
| 5,931,478 A | * | 8/1999 | Chang | 180/906 |
| 5,947,486 A | | 9/1999 | Zell | 280/11.21 |
| 5,951,027 A | | 9/1999 | Oyen et al. | 280/11.22 |
| 5,954,348 A | | 9/1999 | Santarsiero et al. | 280/11.21 |
| 5,979,916 A | | 11/1999 | Gatel et al. | 280/11.22 |
| 6,196,557 B1 | * | 3/2001 | Gerard | 280/11.28 |
| 6,308,964 B1 | * | 10/2001 | Chang | 280/11.19 |
| 6,343,800 B2 | * | 2/2002 | Clementi | 280/11.223 |

* cited by examiner

*Primary Examiner*—Anne Marie Boehler
*Assistant Examiner*—Paul Royal, Jr.
(74) *Attorney, Agent, or Firm*—Barlow, Josephs & Holmes, Ltd.

(57) ABSTRACT

A roller skate comprising a shoe portion having a sole with front and rear regions and a cantilevered member having a free end proximate the front region of the skate and a fixed end opposite the free end. A supporting member is located between and contacting the cantilevered member and the sole. A plurality of front wheels are coupled to each other by a front axle. The front axle biases the free end of the cantilevered member. The skate further includes means for adjusting the position of the supporting member relative to the front axle. The position of the supporting member defines the sizes of the fixed end and the free end of the cantilevered member such that, when the adjusting means moves the supporting member away from the front region of the shoe portion, the size of the free end of the cantilevered member increases, permitting an increased amount of vertical movement of the free end of the cantilevered member and the front axle.

15 Claims, 6 Drawing Sheets

ROLLER SKATE

TECHNICAL FIELD

This invention relates generally to roller skates. More particularly, this invention relates to a roller skate for an infant or child that includes a variety of features for helping the user learn to skate successfully and safely.

BACKGROUND OF THE INVENTION

Roller skates have been widely sold and are well known in both the sporting goods and children's toy industries. During recent years, many different types of roller skates have been developed having different functions and configurations. One particular type of skate is a "beginner's skate" that is intended for young children or other individuals who have not learned how to roller skate in a proficient manner. Most beginner's skates include four or more wheels with at least two sets of parallel wheels, with one set located in the front portion of the skate and one set located in the back portion of the skate. By having the two front wheels rotate about one axis and the two rear wheels rotate about another axis, instead of having all of the wheels arranged to operate like an "in line skate", the beginner's skate provides the user with an additional amount of balance which can be especially important for an inexperienced skater.

While such conventional roller skates are known in the art, they include a number of shortcomings that can give rise to a number of problems for an inexperienced skater. For example, inexperienced skaters often have difficulty beginning the initial skating motion. When a skater is standing still, he or she must be able to propel themselves from a starting position. This can be extraordinarily difficult for a new skater who has yet to master the use of the skates in even the most fundamental manner. One prior art attempt to solve this problem involves the use of large rubber stoppers affixed to the front of the skate in front of the two front wheels. When a person desires to propel himself from a standing position, he lifts his heel forward, causing the rubber stopper to come into contact with the ground. The user is then able to push himself, using the rubber stopper, into a forward motion. This action, however, has a number of drawbacks. First, this action alone can require a higher degree of coordination than a new skater will often have, especially in the case of an infant or a young child. Second, a stopper made from a rubber or similar material will often become worn out over time, reducing its level of usefulness as time progresses. Third, many users, especially inexperienced users, will often attempt to use the rubber stoppers as a braking mechanism in the event that they are travelling at an excessive or uncontrollable velocity. The stopper, however, should not be used as a brake and, if used as such, can result in the skater falling over, resulting in potentially serious injuries. For these reasons, it has become desirable to develop an alternative structure for allowing a user to propel himself or herself from a standing position.

Additionally, conventional beginner's skates have a number of other shortcomings. For example, it is often desirable to limit the direction of movement of the skate wheels, particularly when an infant or young child is first learning to skate. Many conventional beginner's skates, however, include no method for limiting such movement. Additionally, the feet of young children often grow significantly during the first few years of the child's life. For these reasons, a single sized skate is undesirable since a young child will quickly outgrow such a skate. For these reasons, it is desirable to have a skate that incorporates one of a variety of features that increases the safety to a user or the operational value of the skate itself.

SUMMARY OF THE INVENTION

A roller skate comprises a skate body and first and second front wheels coupled to the body. A front axle couples the front wheels to each other, and a spring is coupled to the skate body and is also biased by the front axle. A support member is coupled to the skate body and contacts the spring. The support member is adjustable such that the degree to which the front axle biases the spring can be modified. A tension adjuster is used to alter the position of the support member. In one embodiment of the invention, both the tension adjuster and the support member include a plurality of mating notches that provide means for changing the support member's position. When a user places an increased force upon the front axle, the front axle biases the spring, making the front of the skate contact the ground and allowing the user to "kick" himself into a skating motion. The skate may also include a pawl and ratchet wheel combination that are used to prevent the backwards motion of one or more rear skate wheels. In another embodiment of the invention, the skate body includes front or back portions that can be separated to increase the size of the skate, enabling an optimum fit to a given user of the roller skate.

Further advantages and features of the present invention will be apparent from the following specification and claims, taken in conjunction with the accompanying drawings, wherein like reference numerals refer to like parts.

DETAILED DESCRIPTION OF THE INVENTION

Figure 1:
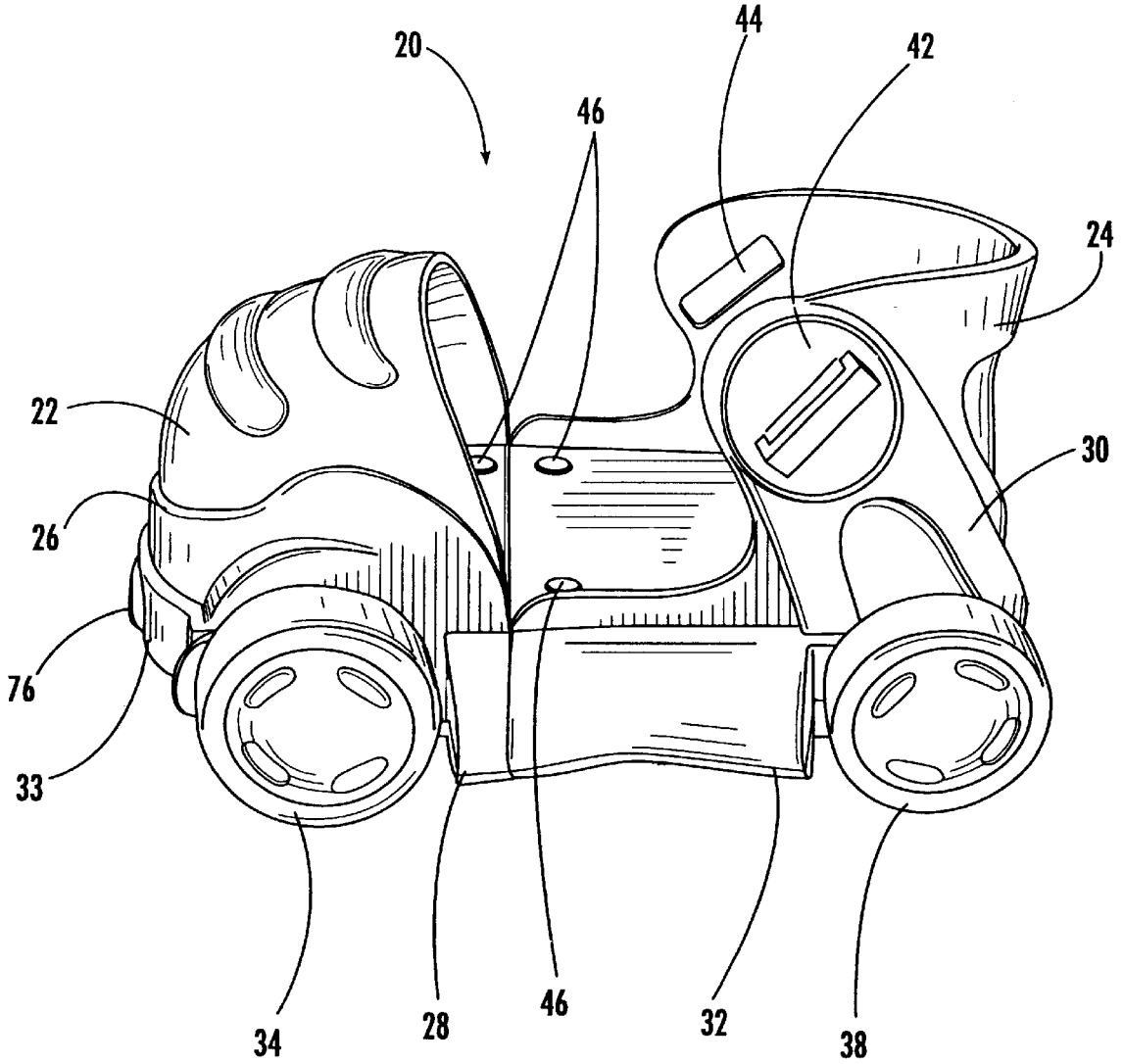
FIG. 1 is an isometric view of a roller skate.
Figure 2:
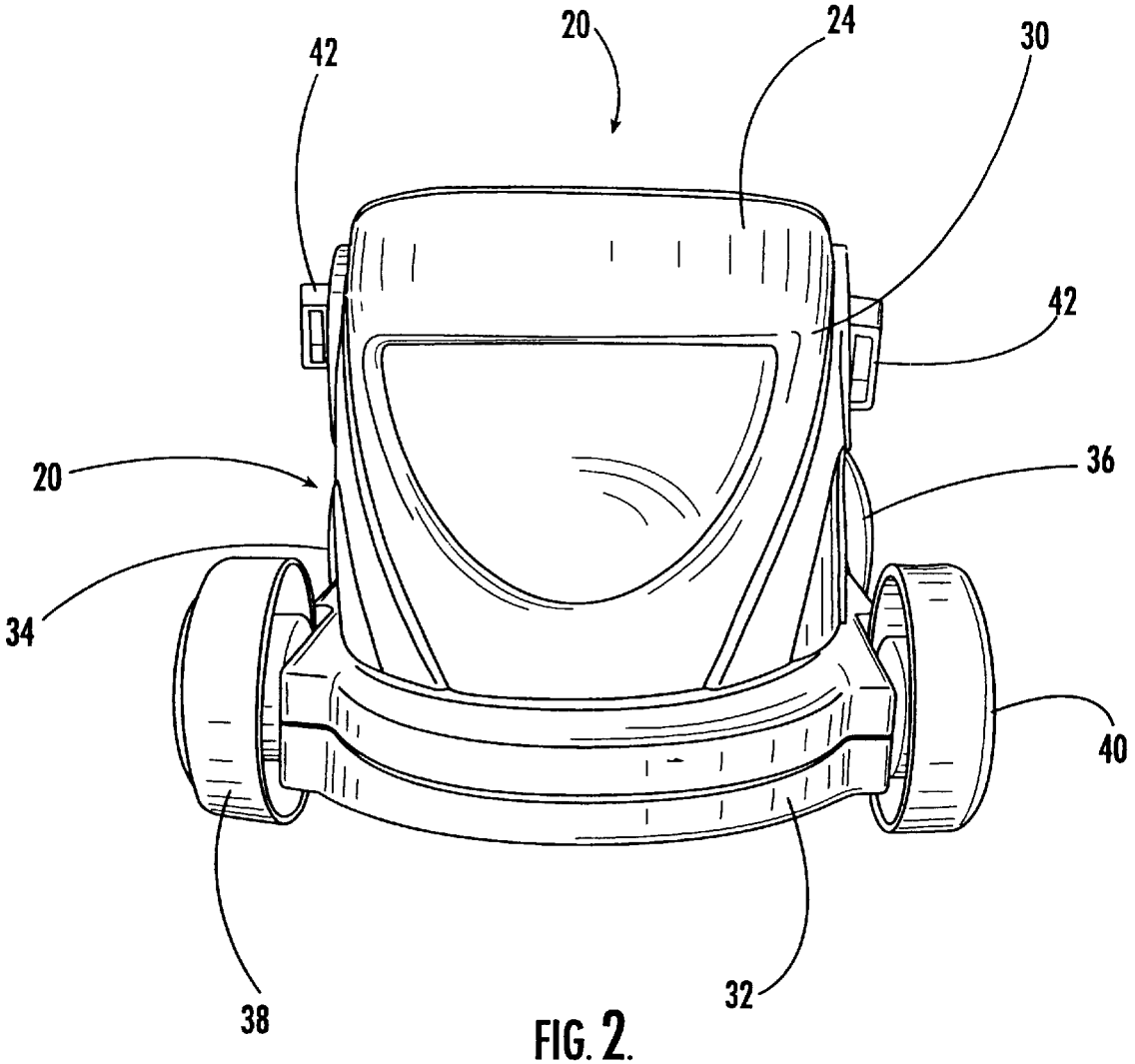
FIG. 2 is a back end view of the roller skate of FIG. 1.
Figure 3:
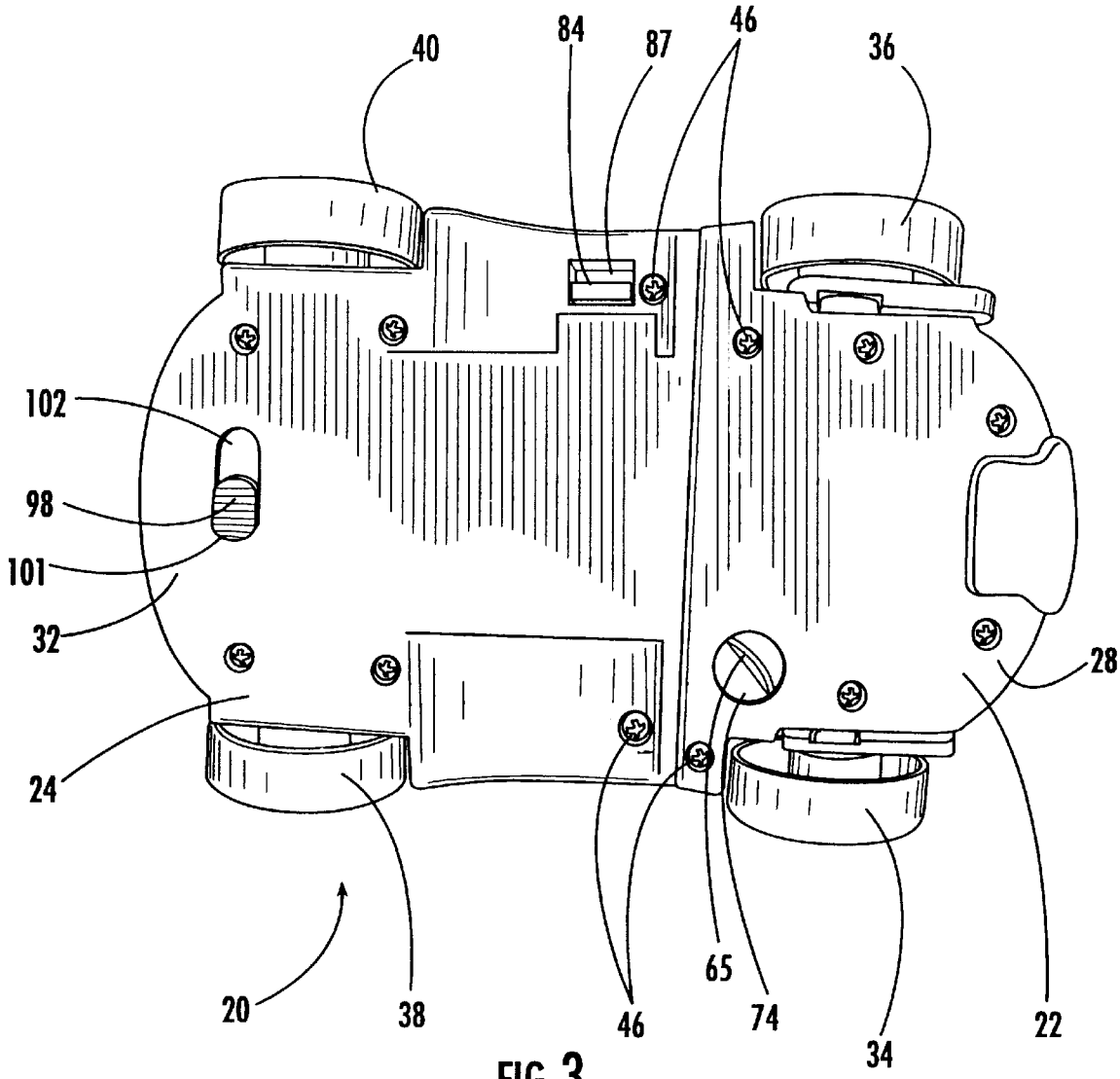
FIG. 3 is a bottom view of the roller skate of FIG. 1.

As described in FIGS. 1–3, a roller skate constructed in accordance with one embodiment of the invention is shown generally at 20, and the roller skate 20 includes a front portion 22 and a rear portion 24. The front portion 22 of the skate 20 includes upper and lower front portions 26 and 28, respectively, while the rear portion 24 of the skate 20 includes upper and lower rear portions 30 and 32, respectively. The front portion 22 further includes left and right front wheels 34 and 36, respectively, while the rear portion 24 includes left and right rear wheels 38 and 40, respectively. The upper rear portion 30 includes a plurality of retaining clips 42 through which a strap (not shown) may be placed, holding the user's foot in place and preventing the foot from sliding out of the skate 20. The retaining clips 42 are placed inside a slot 44 on each side of the upper rear portion 30. In an alternate embodiment of the invention, the retaining clips 42 may be formed as one piece with the upper rear portion 30 via molding or some other method. The strap that is used to hold the user's foot in place can include a conventional Velcro® material to secure the foot, or the strap could simply be tied about itself or fastened by some other conventional method.

The front upper portion 26 is coupled to the lower front portion 28 via a series of screws 46, or other appropriate fastener. Similarly, the rear upper portion 30 is coupled to the lower rear portion 32 via the screws 46.

Figure 4:
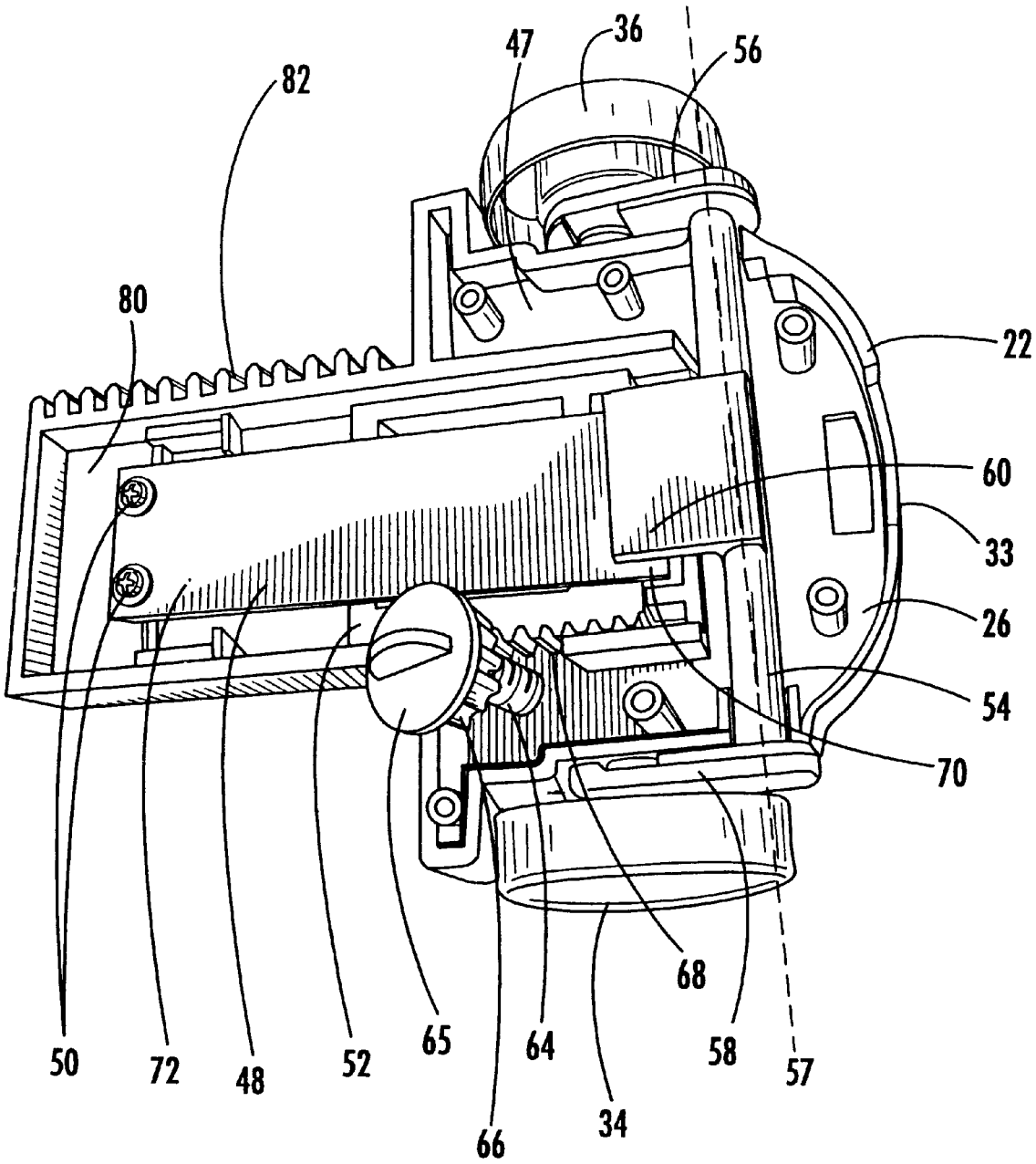
FIG. 4 is a top view of the internal components of the front portion of the skate.
Figure 5A:
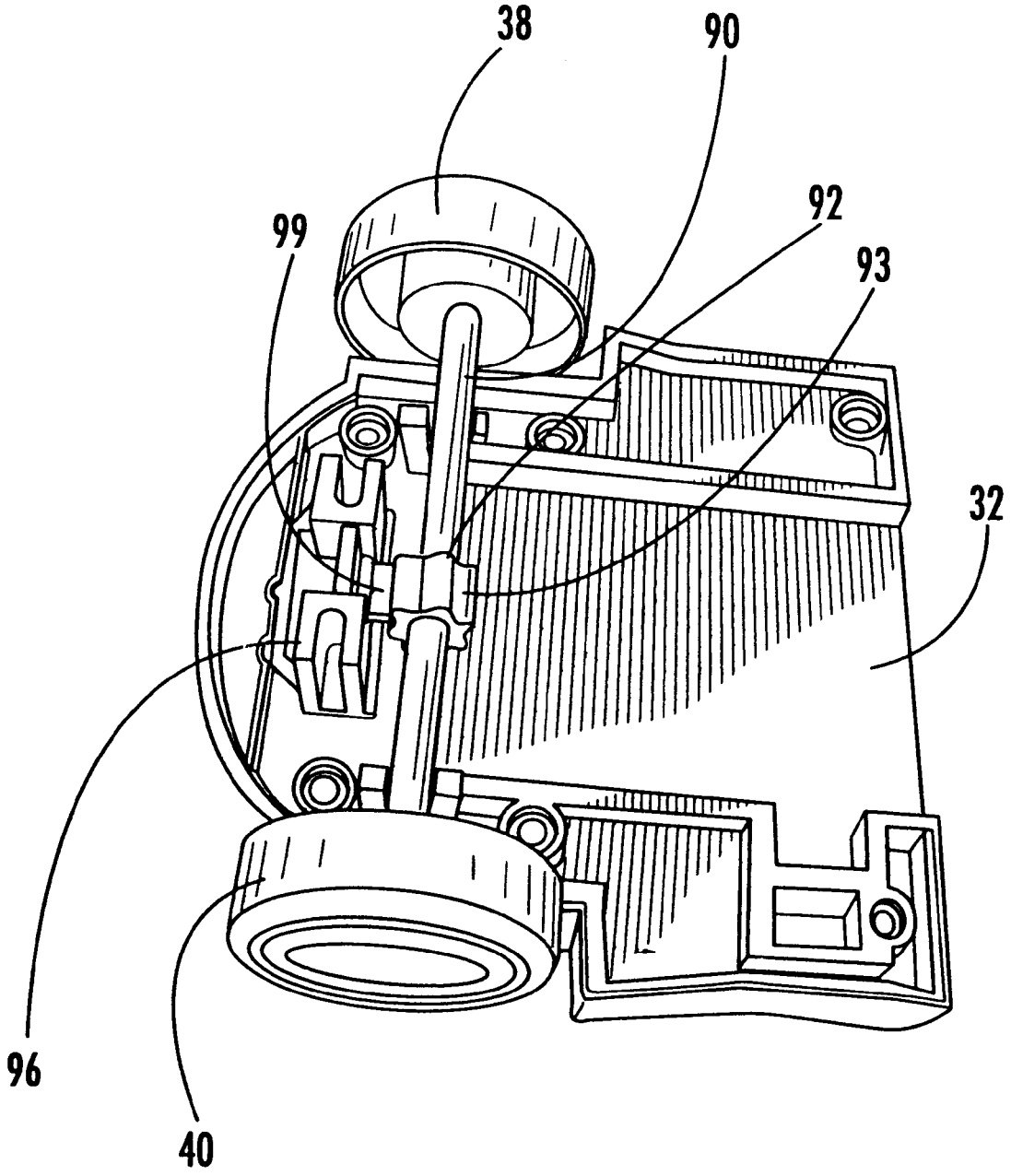
FIGS. 5A and 5B are a top view of the internal components of the rear portion of the skate.
Figure 5B:
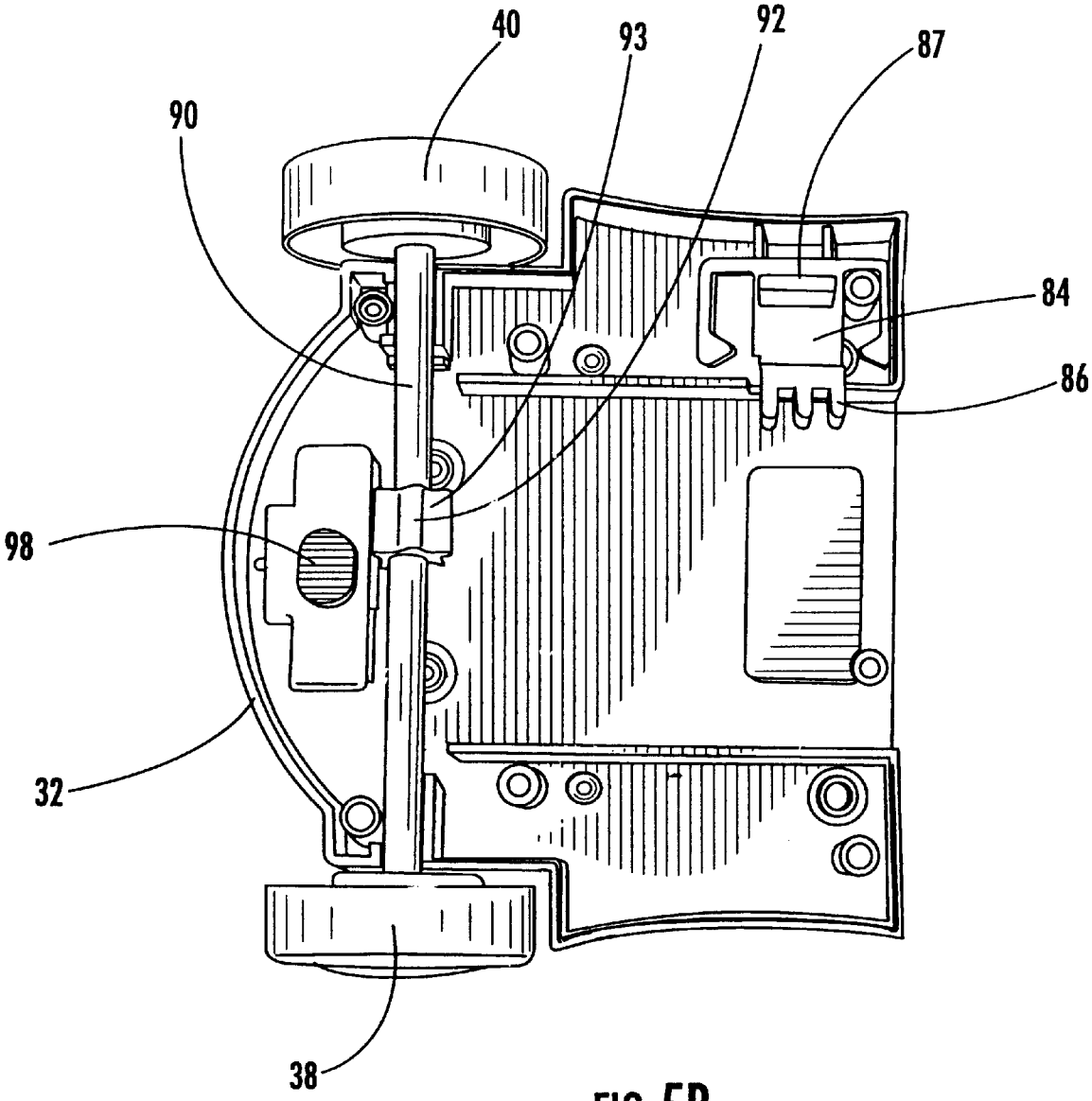

FIGS. 4 and 5 show the internal components that make up the upper and lower front portions 26 and 28. As is seen more clearly in FIG. 4, the lower front portion 22 includes a front foot region 47 and an elongate track 80. Coupled to the elongate track 80 is a cantilevered member 48 that serves as a spring for the front portion 22. The cantilevered member 48 is coupled to the elongate track 80 at one end by a pair of screws 50 (or other conventional fastener). Located between the cantilevered member 48 in the rest of the upper front portion 26 is a support member 52. In a preferred embodiment of the invention, the support member 52 is capable of moving backwards and forwards relative to the front wheels 34 and 36 and the rear wheels 38 and 40 and serves to adjust the relative tension of the cantilevered member 48.

The left and right front wheels 34 and 36 are coupled to each other via a front axle 54 and left and right transverse members 56 and 58, respectively. The front axle 54, in one embodiment of the invention, is located at an axis 57 which is offset from and substantially parallel to an axis running through the left and right front wheels 34 and 36. Located at each end of the front axle 54 are left and right transverse members 56 and 58 that couple the front axle 54 to the left and right front wheels 34 and 36. In one embodiment of the invention, the left and right transverse members 56 and 58 are formed as one piece with the front axle 54, although it is possible for these components to be formed separately. The left and right front wheels 34 and 36 are coupled to the front foot region 47 and the left and right transverse members 56 and 58 via screws (not shown) or other such fasteners. In one preferred embodiment of the invention, the front axle 54 does not spin in conjunction with the left and right front wheels 34 and 36. Instead the left and right front wheels 34 and 36 simply spin about the screws by which they are connected to the front foot region 47.

Coupled to the center region of the front axle 54 is an elongated contact portion 60 that rests directly underneath and biases the cantilevered member 48. In one embodiment of the invention, the contact portion 60 is formed as one piece with the front axle 54, although it is possible for the two components to be formed separately.

The combination of the front axle 54, the support member 52 and the cantilevered member 48 combine to give the front portion 22 of the skate 20 added flexibility when a user begins to skate from a motionless position. The operation of this combination is generally as follows. The placement of the support member 52 adjacent to the cantilevered member 48 operates to separate the cantilevered member 48 into a free end 70 and a fixed end 72, with the fixed end 72 being secured to the elongate track 80 via the screws 50, and the free end 70 contacting the contact portion 60 of the front axle 54. Due to the relative rigidity of the cantilevered member 48, the free end 70 of the cantilevered member 48 biases, or acts against the contact portion 60, inhibiting its movement to a certain degree. The contact portion 60, however, is capable of a certain degree of movement when force is imparted on the left and right front wheels 34 and 36. The degree to which the contact portion 60 is capable of moving about this axis is therefore dependent upon the flexibility of the free end 70 of the cantilevered member 48. The degree of flexibility of the free end 70 is dependent upon the relative position of the support member 52. In the event that the support member 52 is located at the frontmost possible point relative to the front axle 54, the free end 70 (defined as that portion of the cantilevered member 48 between the support member 52 and the front edge of the cantilevered member 48) is quite small. This severely limits the amount of flexibility of the free end 70. As the support member 52 is moved backwards relative to the front axle 54, however, the free end 70 increases in length and size. This allows the free end 70 to bend significantly more than it otherwise could if the support member 52 is in the front most position. With this increased flexibility the contact portion 60 of the front axle 54 is capable of biasing the cantilevered member 48 to a greater degree.

The operation of the skate 20 including the front axle 54, the support member 52 and the cantilevered member 48 is generally as follows. When a user is standing still and desires to "kick" himself into motion, the user transfers tie weight of his foot to the left and right front wheels 34 and 36. Because the left and right front wheels 34 and 36 are movable up and down relative to the skate 20, the downward pressure on the front portion 22 of the skate 20 results in a tendency for the left and right front wheels 34 and 36 to move upward relative to the rest of the skate 20. This upward motion of the left and right front wheels 34 and 36, and the connected contact portion 60 and left and right transverse members 56 and 58, biases or acts against the free end 70 of the cantilevered member 48. It is in this sense that the cantilevered member 48 acts as a spring, working against the contact portion 60 of the cantilevered member 48. The degree to which the left and right front wheels 34 and 36 and connected components are capable of moving upward relative to the rest of the skate 20 will depend upon the size of the free end 70 of the cantilevered member 48. In the instance where the support member 52 is at the frontmost position relative to the front portion 22 of the skate 20, the free end 70 is at a minimum size, simulating an extraordinary stiff spring. When in this position, the contact portion 60 is only capable of moving upwards relative to the rest of the skate 20 upon the application of a maximum relative force. In one embodiment of the skate 20, the left and right front wheels 34 and 36 may not be able to move upwards at all in certain cases. In the event that an older or heavier child is using the skate, this may be the preferred position of the support member 52 because it will take a great deal of effort by the child to cause significant force acting on the cantilevered member 48.

When the support member 52 is moved backwards relative to the front portion 22 of the skate 20, the free end 70 of the cantilevered member 48 increases in size and is capable of bending further, resembling a spring that is less stiff than previously described. In such a case, the same amount of force applied against the front axle 54 will cause a larger degree of biasing against the free end 70 of the cantilevered member 48, allowing the front wheels 34 and 36 to move upwards relative to the rest of the skate 20. This could be particularly beneficial for very young and lightweight children who would have more difficulty in applying a significant amount of force to the left and right front wheels 34 and 36.

The effect of the contact portion 60 moving upwards relative to the rest of the skate 20 is that a front tip 33 of the skate 20 is capable of coming closer to the ground or other surface upon which the skate rests than it would otherwise be able to if the front wheels 34 and 36 were incapable of vertical movement. Therefore, when the user provides a sufficient force to move the front wheels 34 and 36 significantly, the front tip 33 of the skate 20 will actually come into contact with the ground. Because the front tip 33 is substantially rigid in one embodiment of the invention, the user is capable of "pushing off" with the skate 20 when the tip 33 is in contact with the ground. This is particularly beneficial for young children and inexperienced skaters who often have difficulty in beginning the skating motion from a standing position. In one embodiment of the invention, the front tip 33 will comprise a separate tab 76 that is coupled to the rest of the upper front portion 26 of the skate 20. The front tab 76 adds some flexibility to the front portion 22 of the skate and it can also make the front tab 76 easily replaceable in the case of excessive wear and/or damage.

A variety of means are well known in the art for moving the support member 52 towards or away from the front portion 22 of the skate 20. In one embodiment of the invention, the skate 20 includes a tension adjuster 65 including an adjuster spring 64 wrapped around a support (not shown). On the lower portion of the tension adjuster 65 are a plurality of first notches 66. On the support member 52 are a corresponding plurality of second notches 68. The first notches 66 of the adjuster 65 and second notches 68 of the support member 52 are capable of mating such that, when the tension adjuster 65 is turned counterclockwise, the mating action of the first notches 66 and the second notches 68 causes the support member 52 to move backwards relative to the front portion 22 at a skate 20. Similarly, when the tension adjuster 65 is moved in the clockwise direction, the mating action of the first and second notches 66 and 68 moves the support member 52 forward relative to the front portion 22 of the skate 20. This permits the user to change the effective size of the free end 70 of the cantilevered member 48, altering the amount of stiffness of the cantilevered member 48 and the amount of force required to move the front axle 54. The tension adjuster 65 is accessible from the bottom of the skate 20 through a hole 74 in the lower front portion 28 of the skate 20.

Another embodiment of the invention also includes a feature that allows the user to change the size of the skate 20 such that users with different foot sizes can use the same skate 20. As shown in FIGS. 4 and 5, the upper front portion 26 includes the elongate track 80, while the rear portion 24 includes a size adjuster 84. The elongate track 80 includes a plurality of third notches 82 on one side thereof and the size adjuster 84 includes complimentary fourth notches 86 on one side thereof. The third and fourth notches 84 and 86 are arranged such that they are capable of mating with each other, effectively fixing the relative positions of the elongate track 80 and the size adjuster 84. As can be seen best in FIG. 3, the size adjuster 84 includes a size adjuster switch 87 that can be accessed by the user at the bottom of the skate 20. When not being manipulated by the user, the size adjuster switch 87 is in such a position such that the fourth notches 86 and the third notches 82 are matingly engaged with each other, effectively fixing both parts and preventing them from moving. When the user adjusts the size adjuster switch 87, however, the fourth notches 86 are moved out of engagement with the third notches 82. When the third and fourth notches 82 and 86 are not in engagement with each other, the user may pull the front and rear portions 22 and 24 away from each other, effectively extending the length of the skate 20. When the user has pulled the front and rear portions 22 and 24 to an adequate distance to fit the user's foot, the user allows the size adjuster switch 87 to go back into its original position. This action forces the fourth notches 86 to reengage the third notches 82 at a different position. This locks the new size of the skate 20 in place, providing the user with a different sized skate 20.

As can be seen in FIGS. 2, 3, and 5, the left and right rear wheels 38 and 40 are coupled to each other by a rear axle 90. Located on the rear axle 90 is a ratchet wheel 92, including a plurality of grooves 93. The rear wheels 38 and 40, the rear axle 90 and the ratchet wheel 92 are coupled to each other such that all of the components rotate about the same axis with substantially similar rotational velocities. A rear wheel switch 96 is coupled to the lower rear portion 32 of the skate 20. The rear wheel switch 96 includes a pawl 99 that is capable of moving into and out of engagement with the grooves 93 on the ratchet wheel 92. The grooves 93 are arranged such that, when the pawl 99 is in a position to engage the grooves 93, the rear axle 90, the ratchet wheel 92 and the rear wheels 38 and 40 are incapable of rotating in the backwards direction. This has the effect of preventing the skate 20 from rolling backwards when the rear wheel switch 96 is in the appropriate position. As can be seen more clearly in FIG. 3, the rear wheel switch 96 can be actuated by moving switch member 98 between first and second positions 101 and 102. When the switch member 98 is in the first position 101, the pawl 94 is located away from the ratchet wheel 92. This permits the skate 20 to move both forwards and backwards. When the switch member 98 is in the second position 102, the pawl 99 is in a position such that it is capable of engaging the ratchet wheel 92, preventing the rear wheels 38 and 40 from rotating backwards. This serves as an additional safety feature for new and inexperienced users, since such users would not need to worry about potentially losing their balance and/or falling should the wheels inadvertently slip backwards.

While several preferred embodiments have been shown and described in this application, it is understood that changes and modifications can be made to the invention without departing from the invention's broader aspects. For example, it is possible to use other means, such as coil springs, to serve as a biasing spring for the front axle. Furthermore, it is possible to develop skates that do not incorporate some of the safety features, such as the anti-rollback feature. It is also possible to develop a skate that does not incorporate the size adjusting feature described in the application. Therefore, the present invention is not limited to the described and illustrated embodiments, but only by the scope and spirit of the independent and dependent claims.

What is claimed is:

1. A roller skate, comprising:

a first region;

a second region adjustably connected to the first region;

a cantilevered member having a free end proximate the front region of the skate and a fixed end opposite the free end; and a supporting member located between and contacting the cantilevered member;

a first wheel;

a second wheel;

a first axle coupled to the first and second wheels and biasing the free end of the cantilevered member; and means for adjusting the position of the supporting member relative to the first axle; and wherein the position of the supporting member defines the sizes of the fixed end and the free end of the cantilevered member such that, when the adjusting means moves the supporting member away from the first region, the size of the free end of the cantilevered member increases, permitting an increased amount of vertical movement of the free end of the cantilevered member and the first axle.

2. The roller skate of claim 1, further comprising:

a second axle substantially parallel to the first axle and coupled to the second region; and at least one wheel coupled to the second axle.

3. The roller skate of claim 2, further comprising:

ratcheting means for selectively engaging the second axle, whereby the ratcheting means, upon engaging the second axle, inhibits the rearward rotation of the at least one wheel coupled to the second axle.

4. The roller skate of claim 3, further comprising:

means for moving the ratcheting means into and out of an engagement position with the second axle.

5. The roller skate of claim 1, further comprising:

a connecting member coupling the first region and the second region to each other.

6. The roller skate of claim 5, further comprising:

means for adjusting the distance between the first region and the second region.

7. A skate, comprising:

a skate body;

a plurality of front wheels;

a plurality of rear wheels;

a front axle coupling the front wheels to each other;

a spring coupled to the skate body and biased by the front axle;

a tension adjuster;

the tension adjuster acting against the support member for adjusting the amount that the axle biases the spring;

the tension adjuster and support member each including a plurality of mating tension adjuster and support member notches, the movement of the tension adjuster causing the tension adjuster notches to act against the support member notches, thereby adjusting position of the support member relative to the spring; and a support member for adjusting the amount of force that the front axle biases the spring.

8. The skate of claim 7, wherein the spring includes a cantilevered member with a free end biasing the first axle and a fixed end opposite the free end.

9. The skate of claim 7, wherein the front axle comprises:

a cross member;

a first transverse member substantially perpendicular and coupled to the cross member, the first transverse member coupled to a first front wheel; and a second transverse member substantially perpendicular and coupled to the cross member, the second transverse member coupled to a second front wheel.

10. The skate of claim 9, wherein the first and second front wheels rotate about an axis translationally offset from the axis including the cross member, the front wheels capable of adjusting their position relative to the skate while biasing the spring.

11. The skate of claim 7, further comprising:

a rear axle coupling the rear wheels to each other;

a ratchet wheel coupled to the rear axle; and a pawl located proximate to the ratchet wheel, the pawl capable of engaging the ratchet wheel to prevent the rearward rotation of the rear wheels.

12. The skate of claim 11, further comprising means for moving the pawl into and out of engagement with the ratchet wheel.

13. The skate of claim 7, further comprising means for adjusting the length of the skate body.

14. A roller skate, comprising:

a skate body;

a plurality of wheels coupled to the skate body;

an axle coupled to at least one of the wheels;

a spring for biasing the axle, said spring including means such that when a force is imparted upon the skate in the vicinity of the axle, the spring biases the axle to inhibit at least one wheel's vertical motion relative to a surface upon which the skate placed;

a support member coupled to the skate body;

a tension adjuster coupled to the skate body, wherein the tension adjuster acts against the support member to alter the degree to which the spring biases the axle; and means for inhibiting the rearward motion of the roller skate.

15. The roller skate of claim 14, wherein the spring comprises a cantilevered member having a free end contacting the axle and a fixed end opposite the free end.

* * * * *